United States Patent [19]

Anderson et al.

[11] 4,364,817

[45] Dec. 21, 1982

[54] METHOD FOR CONTROLLING BOILING POINT DISTRIBUTION OF COAL LIQUEFACTION OIL PRODUCT

[75] Inventors: Raymond P. Anderson, Overland Park, Kans.; David K. Schmalzer, Englewood, Colo.; Charles H. Wright, Overland Park, Kans.

[73] Assignee: The Pittsburg & Midway Coal Mining Co., Englewood, Colo.

[21] Appl. No.: 237,762

[22] Filed: Mar. 4, 1981

[51] Int. Cl.[3] ..... C10G 1/00; C10G 1/06

[52] U.S. Cl. ..... 208/8 LE; 208/10

[58] Field of Search ..... 208/10, 8 LE

[56] References Cited

U.S. PATENT DOCUMENTS

| | | | |
|---|---|---|---|
| 3,075,912 | 1/1963 | Eastman et al. | 208/8 |
| 3,726,785 | 4/1973 | Keller et al. | 208/8 |
| 3,790,467 | 2/1974 | Fiocco et al. | 208/8 |
| 4,045,329 | 8/1977 | Johanson et al. | 208/10 |
| 4,152,244 | 5/1979 | Raichle et al. | 208/8 R |
| 4,159,236 | 6/1979 | Schmid | 208/10 |
| 4,159,237 | 6/1979 | Schmid | 208/10 |
| 4,211,631 | 7/1980 | Carr et al. | 208/8 LE |
| 4,222,845 | 9/1980 | Schmid | 208/8 LE |
| 4,230,556 | 10/1980 | Carr et al. | 208/8 LE |
| 4,255,248 | 3/1981 | Rosenthal et al. | 208/10 X |

*Primary Examiner*—Delbert E. Gantz
*Assistant Examiner*—William G. Wright
*Attorney, Agent, or Firm*—Deane E. Keith; Forrest D. Stine; Alvin E. Ring

[57] ABSTRACT

The relative ratio of heavy distillate to light distillate produced in a coal liquefaction process is continuously controlled by automatically and continuously controlling the ratio of heavy distillate to light distillate in a liquid solvent used to form the feed slurry to the coal liquefaction zone, and varying the weight ratio of heavy distillate to light distillate in the liquid solvent inversely with respect to the desired weight ratio of heavy distillate to light distillate in the distillate fuel oil product. The concentration of light distillate and heavy distillate in the liquid solvent is controlled by recycling predetermined amounts of light distillate and heavy distillate for admixture with feed coal to the process in accordance with the foregoing relationships.

27 Claims, 3 Drawing Figures

PIPELINE GAS
LPG
CRYOGENIC SEPARATION
AUTOMATIC CONTROL
NAPHTHA
ACID GAS REMOVAL
SULFUR
VACUUM TOWER
PURIFIED HYDROGEN
LIQUID
ATMOSPHERIC FRACTIONATOR
VAPOR-LIQUID SEPARATORS
PRODUCT SLURRY
DISSOLVER
SLURRY PREHEATER
MAKE-UP HYDROGEN
SLURRY MIXING TANK
DRIED PULVERIZED COAL

METHOD FOR CONTROLLING BOILING POINT DISTRIBUTION OF COAL LIQUEFACTION OIL PRODUCT

The Government of the United States of America has rights in this invention pursuant to Contract No. DE-AC01-79ET14800 awarded by the U.S. Department of Energy to the Pittsburg & Midway Coal Mining Co., a subsidiary of Gulf Oil Corporation.

FIELD OF THE INVENTION

This invention relates to a method of controlling the boiling point distribution of the liquid product of a coal liquefaction process wherein a mineral-containing feed coal is dissolved in a solvent and hydrocracked. More particularly, this invention relates to a method for controlling the relative ratio of heavy distillate to light distillate produced in a coal liquefaction process by continuously controlling the ratio of heavy distillate to light distillate fed to the liquefaction zone.

DESCRIPTION OF THE PRIOR ART

Prior coal liquefaction processes for converting coal into a liquid product disclose the recycle of various boiling range streams as a slurrying liquid for the raw feed coal. U.S. Pat. No. 3,075,912 to Eastman et al discloses the recycle of a heavy oil or a middle distillate to form a slurry of the feed coal in a process for hydroconversion of feed coal to liquid products.

U.S. Pat. No. 4,045,329 to Johanson et al discloses recycle of an 800° F. (427° C.) to 975° F. (524° C.) bottoms fraction to form a slurry that is fed to a coal hydrogenation reactor to improve the yield of liquid product boiling in the range of about 400° F. (204° C.) to 800° F. (427° C.). Additionally, the selective recycle of light distillate boiling in the range of 450° F. (232° C.) to 600° F. (316° C.) along with the heavy gas oil fraction is described as providing viscosity control and resulting in extinguishment of the heavy gas oil fraction. However, the patent teaches that liquid boiling between 600° F. (316° C.) and 800° F. (427° C.) should not be recycled.

U.S. Pat. No. 4,152,244 to Raichle et al discloses the use of a mixture of middle oil (200°-325° C.) and heavy oil (325°-450° C.) as a slurry liquid in a coal hydrogenation process wherein a portion of the recycled oil mixture must be hydrogenated. The patent does not teach that the concentration of a particular distillate fraction produced in a coal liquefaction process can be controlled by controlling the concentration of such fraction relative to another fraction present as solvent liquid fed to a coal liquefaction reaction.

SUMMARY OF THE INVENTION

It has now been found that the weight ratio of a heavy distillate oil fraction (hereinafter referred to as "heavy distillate") to a light distillate oil fraction (hereinafter referred to as "light distillate") produced in a coal liquefaction process varies inversely with the weight ratio of heavy distillate to light distillate fed to the coal liquefaction zone as a liquid solvent, thereby enabling continuous control of the relative yields of light and heavy distillates by controlling the solvent concentration. According to the present invention, a continuous process is provided for controlling the weight ratio of heavy distillate to light distillate produced in a coal liquefaction process, which process comprises passing a mineral-containing feed coal, hydrogen, recycle normally solid dissolved coal, recycle mineral residue and a liquid solvent to a coal liquefaction zone, said liquid solvent comprising a heavy distillate and a light distillate in a predetermined ratio of heavy distillate to light distillate to dissolve the hydrocarbonaceous material in the feed coal and to hydrocrack the dissolved hydrocarbonaceous material to produce a product fuel oil containing heavy distillate and light distillate wherein the weight ratio of heavy distillate to light distillate in the product fuel oil varies inversely with the weight ratio of heavy distillate to light distillate in the liquid solvent. The ratio of heavy distillate to light distillate in the product fuel oil is continuously controlled by controlling the ratio of heavy distillate to light distillate fed to the liquefaction zone.

It is well known that the amount of liquid product from a coal liquefaction process is dependent upon coal concentration, temperature, pressure and residence time. However, the process of the present invention relates to the composition of the liquid product and is based upon the surprising discovery that the weight ratio of heavy distillate to light distillate produced varies inversely with the weight ratio of heavy distillate to light distillate in the feed slurry. Thus, the concentration of light distillate in the product can be increased by increasing the concentration of heavy distillate in the feed slurry. The present discovery provides a means for controlling the composition of oil produced in a coal liquefaction process so that the product fuel oil can be "tailor-made" to provide the desired product mix for consumer demands. For example, light fuel oil product contains about 0.2 to 0.3 weight percent sulfur, whereas heavy fuel oil product contains from about 0.3 to 0.5 weight percent sulfur. Thus, it may become necessary to enhance the relative yield of liquid fuel oil rather than heavy fuel oil so as to meet sulfur specifications.

It was found that the relative yields of light distillate and heavy distillate can be expressed over a wide range of process conditions as a function of the ratio of light distillate to heavy distillate in accordance with the following formulas:

$$LD_2 = LD_1 - 37\,(R_2 - R_1) \quad \text{(I)}$$

$$HD_2 = HD_1 + 28\,(R_2 - R_1) \quad \text{(II)}$$

wherein $LD_2$ = Desired light distillate yield $LD_1$ = Measured light distillate yield $HD_2$ = Desired heavy distillate yield $HD_1$ = Measured heavy distillate yield $R_2$ = Desired weight ratio of light/heavy distillate in feed slurry $R_1$ = Measured weight ratio of light/heavy distillate in feed slurry When using the foregoing algebraic expressions I and II, it is assumed that the other process conditions remain constant. The foregoing yields are in terms of weight percent MAF feed coal.

A suitable light distillate is, for example, a distillate fraction boiling within the range, but not necessarily including components boiling over the entire range of between about 350° F. (177° C.) to about 600° F. (316° C.), preferably between about 380° F. (193° C.) or 400° F. (204° C.) to about 500° F. (260° C.) or 550° F. (288° C.). Likewise, a suitable heavy distillate is, for example, a distillate fraction boiling within the range, but not necessarily including components boiling over the entire range of between about 500° F. (260° C.) to about 900° F. (482° C.), preferably between about 550° F. (288° C.) or 600° F. (316° C.) to about 800° F. (427° C.) or 850° F. (454° C.).

According to one embodiment of the present invention, the production of light distillate is maximized by controlling the ratio of heavy distillate to light distillate in the feed slurry at a value in the range of greater than 3:1 or 5:1 on a weight basis, preferably from about 4:1, 5:1 or 7:1 to about 20:1 or 30:1 on a weight basis. The resulting ratio of heavy distillate to light distillate in the product is less than about 1.5:1, preferably between about 0.2:1 to 1:1 on a weight basis.

According to another embodiment of the present invention, the production of heavy distillate is maximized by controlling the ratio of light distillate to heavy distillate in the feed slurry to a value greater than 0.4:1, preferably in the range of between about 0.4:1 to about 4:1, most preferably between about 0.6:1 to about 3:1 on a weight basis. This results in a light distillate to heavy distillate ratio in the fuel oil distillate product in the range of less than 0.6:1, for example, between about 0.01:1 to about 0.6:1, preferably between about 0.05:1 to about 0.3:1 on a weight basis.

DESCRIPTION OF THE PREFERRED EMBODIMENTS

Figure 1:
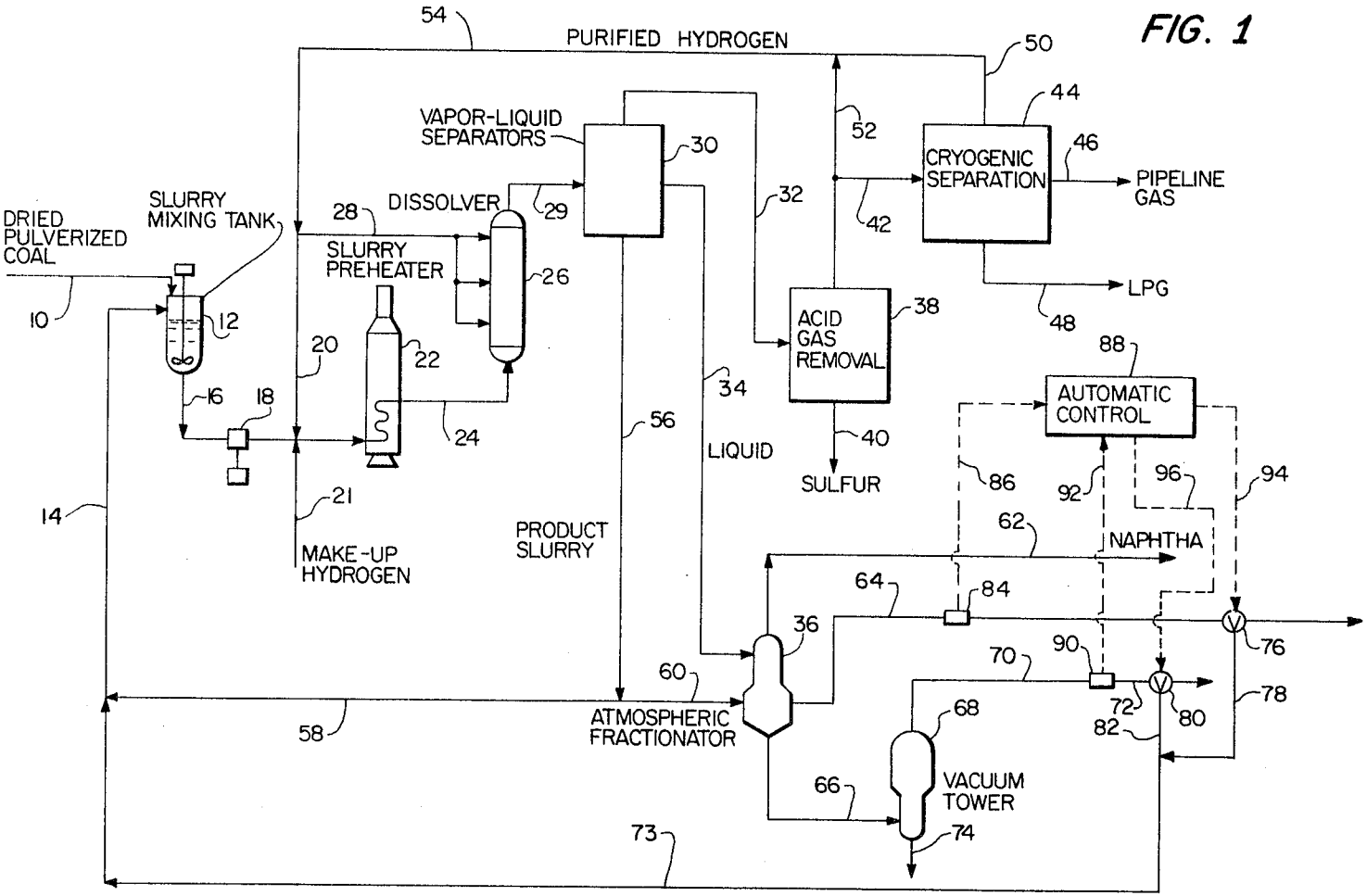
FIG. 1 is a schematic flow diagram of a process for continuously controlling the relative ratio of light distillate to heavy distillate in the fuel oil product.

As shown in the process set forth in FIG. 1 of the drawings, dried and pulverized raw coal is passed through line 10 to slurry mixing tank 12 wherein it is mixed with recycle slurry containing recycle normally solid dissolved coal, recycle mineral residue and recycle hot distillate solvent boiling in the range of between about 350° F. (177° C.) and about 900° F. (482° C.) flowing in line 14. The resulting feed slurry contains heavy distillate and light distillate in a weight ratio of heavy distillate to light distillate of about 15:1. If it is desired to enhance the light distillate relative yield, then the aforesaid ratio of heavy distillate to light distillate can be increased to a ratio of, for example, 20:1. Fresh supplies of light and heavy distillate from an outside source (not shown) can be added to slurry mixing tank 12 if desired. Preferably, no fresh distillate is required. In the preferred operation of the process, an extraneous catalyst (non-feed coal derived) is not required.

The solvent-containing feed slurry mixture containing, for example, 1 to 4, preferably, 1.5 to 2.5 parts by weight of recycle material to one part by weight of feed coal in line 16 is pumped by means of reciprocating pump 18 and admixed with recycle hydrogen entering through line 20 and with make-up hydrogen entering through line 21 prior to passage through tubular preheater furnace 22 from which it is discharged through line 24 to dissolver 26. The ratio of hydrogen to feed coal can be about 40,000 SCF/ton (1.24 $M^3$/kg).

The temperature of the reactants at the outlet of the preheater is about 700° F. (371° C.) to 760° F. (404° C.). At this temperature the coal is partially dissolved in the recycle solvent, and the exothermic hydrogenation and hydrocracking reactions are just beginning. Whereas the temperature gradually increases along the length of the preheater tube, the dissolver is at a generally uniform temperature throughout and the heat generated by the hydrocracking reactions in the dissolver raise the temperature of the reactants to the range 820° F. (438° C.) to 870° F. (466° C.). Hydrogen quench passing through line 28 is injected into the dissolver at various points to control the reaction temperature and alleviate the impact of the exothermic reactions.

The conditions in the dissolver include a temperature in the range of 750° to 900° F. (399° to 482° C.), preferably 820° to 870° F. (438° to 466° C.) and a residence time of 0.1 to 4.0 hours, preferably 0.2 to 2 hours. The pressure is in the range of 1,000 to 4,000 psi and is preferably 1,500 to 3,000 psi (70 to 280 kg/$cm^2$, preferably 150 to 210 kg/$cm^2$).

The dissolver effluent passes through line 29 to vapor-liquid separator system 30. The hot overhead vapor stream from these separators is cooled in a series of heat exchangers and additional vapor-liquid separation steps and removed through line 32. The liquid distillate from the separators passes through line 34 to atmospheric fractionator 36. The non-condensed gas in line 32 comprises unreacted hydrogen, methane and other light hydrocarbons, along with $H_2S$ and $CO_2$, and is passed to acid gas removal unit 38 for removal of $H_2S$ and $CO_2$. The hydrogen sulfide recovered is converted to elemental sulfur which is removed from the process through line 40. A portion of the purified gas is passed through line 42 for further processing in cryogenic unit 44 for removal of much of the methane and ethane as pipeline gas which passes through line 46 and for the removal of propane and butane as LPG which passes through line 48. The purified hydrogen in line 50 is blended with the remaining gas from the acid gas treating step in line 52 and comprises the recycle hydrogen for the process.

The liquid slurry from vapor-liquid separators 30 passes through line 56 and comprises liquid solvent, normally solid dissolved coal and catalytic mineral residue. Stream 56 is split into two major streams, 58 and 60, which have the same composition as line 56. The temperatures and pressures used in the series of vapor-liquid separators are preferably controlled in such a way as to minimize the concentration of liquid solvent in the slurry in line 56 since there is no independent method of control of the ratio of light distillate to heavy distillate stream in line 56. Thus, by increasing the temperature or lowering the pressure used in vapor-liquid separators 30, the amount of both light and heavy distillate in line 56 can be decreased to a minimal level. If desired, the ratio of light distillate to heavy distillate in line 56 (and thus lines 58 and 60) can be determined by sampling. It is preferred to utilize conditions in the vapor-liquid separators 30 which will maintain the amount of light distillate and heavy distillate at a substantially constant value in line 56. By minimizing the quantity of liquid solvent in line 56, the control of the light to heavy ratio in the process through controlled addition of distilled fractions is facilitated. The slurry in line 58 is recycled and joins line 73 to form stream 14 which is passed to mixing tank 12. The non-recycled portion of this slurry passes through line 60 to atmospheric fractionator 36 for separation of the major products of the process.

In fractionator 36 the slurry product is distilled at atmospheric pressure to remove an overhead naphtha stream through line 62, a 350° F. (177° C.) to 600° F. (316° C.) light distillate stream through line 64 and a bottoms stream through line 66. The bottoms stream in line 66 passes to vacuum distillation tower 68. The temperature of the feed to the fractionation system is normally maintained at a sufficiently high level that no additional preheating is needed, other than for start-up operations. A heavy distillate stream comprising 600° F. (316° C.) to 800° F. (427° C.) material is withdrawn from the vacuum tower through line 70. The combination of the light and heavy distillates in lines 64 and 70 makes up the major fuel oil product of the process. The relative yields of the light distillate and heavy distillate in lines 64 and 70, respectively, can be controlled by controlling the concentration of light distillate and heavy distillate in the feed slurry in process line 16.

Control of the concentration of light and heavy distillate in the feed slurry can be accomplished by any suitable means. Preferably, such concentration is controlled by automatically and continuously controlling the amount of light and heavy distillate fractions which are passed to line 73 for recycle to the slurry mixing tank by means of line 14. The concentration of the light distillate in line 73 is thus controlled by automatically and continuously controlling the rate of light distillate introduced into line 73 by means of three-way valve 76 and line 78.

Similarly, the concentration of heavy distillate in line 73 is controlled by automatically and continuously controlling the rate of heavy distillate introduced into line 73 by means of three-way valve 80 and line 82. The amount of light distillate passing through line 64 is automatically and continuously monitored by measuring device 84, and the resulting signal is transmitted by means of output line 86 to the automatic control instrument 88. Likewise, the amount of heavy distillate passing through line 72 is monitored by measuring device 90 and the signal is automatically and continuously transmitted by output line 92 to automatic control instrument 88. In response to the output signals received from flow measuring sensors 84 and 90, the automatic control instrument regulates the amount of light distillate recycled by controlling automatic valve 76 by means of input line 94. Similarly, the amount of heavy distillate that is recycled is controlled by the automatic control instrument 88 by regulating the operation of automatic valve 80 by means of input line 96.

In this way, the concentration of light distillate and heavy distillate in the feed slurry is continuously and automatically controlled in response to the concentration of similar distillate fractions in the product of the process. Automatic control instrument 88 and flow measuring sensors 84 and 90 can be of conventional design well known to the art, and can be, for example, differential pressure, thermal or sonic type flow measuring devices.

By controlling the ratio of heavy distillate to light distillate in the feed slurry, for example, to between about 5:1 to about 15:1, the ratio of heavy distillate to light distillate withdrawn as a fuel oil product by means of lines 72 and 64, respectively, can be controlled within a range of between about 0.2:1 to about 1:1.

The bottoms from vacuum tower 68, consisting of all the normally solid dissolved coal, undissolved organic matter and mineral matter of the process, but essentially without any distillate liquid or hydrocarbon gases is discharged by means of line 74, and may be processed as desired. For example, such stream may be passed to a partial oxidation gasifier to produce hydrogen for the process in the manner described in U.S. Pat. No. 4,159,236 to Schmid, the disclosure of which is hereby incorporated by reference. The process as depicted in FIG. 1 does not employ any hydrogenation reaction zone involving either catalytic or non-catalytic hydrogenation downstream from dissolver 26 prior to separation of the liquid into light and heavy distillate fractions in fractionator 36 and vacuum tower 68. Thus, the recycle light distillate and heavy distillate are unhydrogenated.

The following examples are not intended to limit the invention, but rather are presented for purposes of illustration. All percentages are by weight unless otherwise indicated.

EXAMPLE 1

Six tests were conducted to demonstrate the effect of varying the concentration of light distillate and heavy distillate in the feed to a coal liquefaction process upon the composition of the product fuel oil. Pittsburgh seam coals were used in the tests. In Tests 1–3 the Pittsburgh seam coal used had the following analysis:

| Pittsburgh Seam Coal (Percent by Weight-Dry Basis) | |
|---|---|
| Carbon | 73.41 |
| Hydrogen | 5.10 |
| Sulfur | 3.37 |
| Nitrogen | 1.29 |
| Oxygen | 11.62 |
| Ash | 9.5 |
| Moisture | — |

Tests 4–6 were conducted using a Pittsburgh seam coal from a different location having a slightly higher ash content of 11.7 weight percent on a weight basis.

A feed slurry is prepared for each test by mixing pulverized coal with liquid solvent and a recycle slurry containing liquid solvent, normally solid dissolved coal and catalytic mineral residue. The feed slurry was formulated such that the ratio of the light oil fraction (approximate boiling range 193°–282° C., 380°–540° F.) to heavy oil fraction (approximate boiling range 282°–482° C., 540°–900° F.) in the liquid solvent was varied, while the total amount of the two oil fractions remained relatively constant, varying only from 34.2 to 36.8 weight percent of the total feed slurry composition. The coal concentration in the feed slurry was 30 weight percent and the pressure was 1800 psig (126 kg/cm$^2$) using an average dissolver temperature of 455°–457° C. (851°–855° F.). The hydrogen feed rate was 49–72 MSCF/ton of coal (1.52–2.23 M$^3$/kg). The coal feed rate was 21.0–21.5 lb/hr/ft$^3$, which corresponds to a nominal slurry residence time of 1.0–1.02 hour.

The feed slurry composition for the various tests is set forth in Table I below:

TABLE I

| Feed Slurry Composition, | Test No. | | | | | |
|---|---|---|---|---|---|---|
| Wt. % Based on Slurry | 1 | 2 | 3 | 4 | 5 | 6 |
| Coal | 30.0 | 30.0 | 30.0 | 30.0 | 30.0 | 30.0 |

TABLE I-continued

| Feed Slurry Composition, Wt. % Based on Slurry | Test No. 1 | 2 | 3 | 4 | 5 | 6 |
|---|---|---|---|---|---|---|
| Light Distillate | 7.2 | 8.1 | 3.0 | 7.4 | 4.1 | 11.5 |
| Heavy Distillate | 28.3 | 28.5 | 33.8 | 28.3 | 30.6 | 22.7 |
| Total of Light and Heavy Distillates | 35.5 | 36.6 | 36.8 | 35.7 | 34.7 | 34.2 |
| Ratio of Heavy Distillate to Light Distillate | 3.9 | 3.5 | 11.3 | 3.8 | 7.5 | 2.0 |
| Normally Solid Dissolved Coal | 22.4 | 22.1 | 21.3 | 20.7 | 21.3 | 19.8 |
| Ash* | 8.2 | 7.4 | 8.0 | 9.3 | 9.7 | 10.2 |
| Insoluble Organic Matter* | 3.9 | 3.9 | 3.9 | 4.3 | 4.3 | 5.8 |
| Total Solids | 42.1 | 41.3 | 41.9 | 43.6 | 44.0 | 46.0 |

*Ash and Insoluble Organic Matter together constitute the mineral residue.

The composition of the feed slurry was adjusted in part by varying the temperature of the high pressure separator (350°-390° C.) and the distillation column, but more importantly, by the slurry formulation procedure. Light distillate and heavy distillate were collected separately. The light distillate has an approximate boiling range of 193° C., 380° F., to 282° C., 540° F. (atmospheric boiling point corrected from actual cut point of 108° C. at 2 mmHg). The heavy distillate has an approximate boiling range of 282° C., 548° F., to 482° C., 900° F. (atmospheric boiling point corrected from actual cut point of 270° C. at 2 mmHg). The ratio of light distillate and heavy distillate used in slurry formulation was adjusted to provide the desired feed slurry composition as shown in Table I above. The results of the various tests are set forth in Table II below:

TABLE II

| Yields, Wt. % Based on MAF Coal | Test No. 1 | 2 | 3 | 4 | 5 | 6 |
|---|---|---|---|---|---|---|
| $C_1$-$C_4$ | 15.7 | 15.0 | 16.6 | 17.7 | 15.6 | 15.4 |
| Naphtha ($C_{5+}$ – 193° C.) | 13.5 | 12.9 | 13.1 | 9.9 | 10.3 | 15.9 |
| Light Distillate | 17.5 | 15.2 | 22.5 | 14.2 | 21.6 | 7.4 |
| Heavy Distillate | 13.1 | 15.3 | 8.8 | 15.4 | 9.4 | 20.1 |
| Total of Light and Heavy Distillates | 30.6 | 30.5 | 31.3 | 29.6 | 31.0 | 27.5 |
| Ratio of Heavy Distillate to Light Distillate | 0.7 | 1.0 | 0.4 | 1.1 | 0.4 | 2.7 |
| Normally Solid Dissolved Coal | 28.7 | 30.9 | 27.7 | 30.8 | 29.7 | 26.0 |
| Insoluble Organic Matter | 5.1 | 5.4 | 5.1 | 6.4 | 6.0 | 7.7 |
| $H_2$ Reacted | 5.6 | 5.2 | 5.3 | 6.0 | 5.2 | 4.7 |

The results set forth in Table II demonstrate that the yields of light and heavy distillate are strongly affected by the levels of such materials in the feed slurry. For example, comparing Tests 3 and 6, it is seen that increasing the light distillate concentration in the feed slurry from 3.0 to 11.5 weight percent resulted in decreasing the light distillate yield from 22.5 to 7.4 weight percent based upon MAF coal. Similarly, increasing the heavy distillate concentration in the feed slurry from 22.7 (Test 6) to 33.8 weight percent (Test 3) resulted in decreasing the heavy distillate yield from 20.1 weight percent (Test 6) to 8.8 weight percent (Test 3). Such large decrease in light distillate yield and corresponding increase in heavy distillate yield with an increase in light distillate concentration in the feed slurry, while the total distillate concentration and yields remain relatively constant, is especially surprising since such strong dependence of yield distribution upon slurry feed composition could not have been predicted. This is demonstrated in FIGS. 2 and 3.

Figure 2:
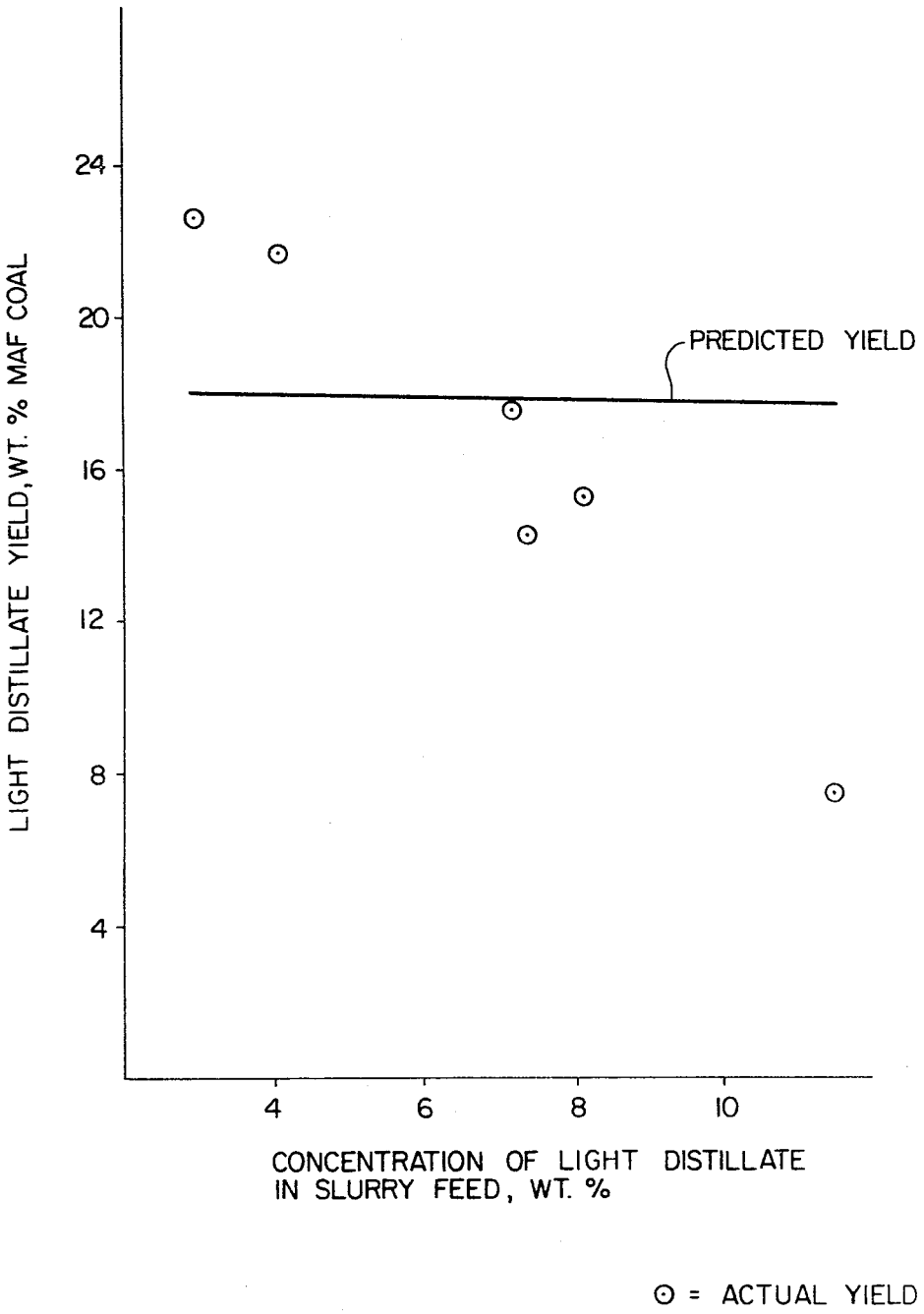
FIG. 2 graphically illustrates the unpredictability of the effect of increasing the concentration of recycle light distillate upon the light distillate yield in accordance with the continuous control process of the present invention.
Figure 3:
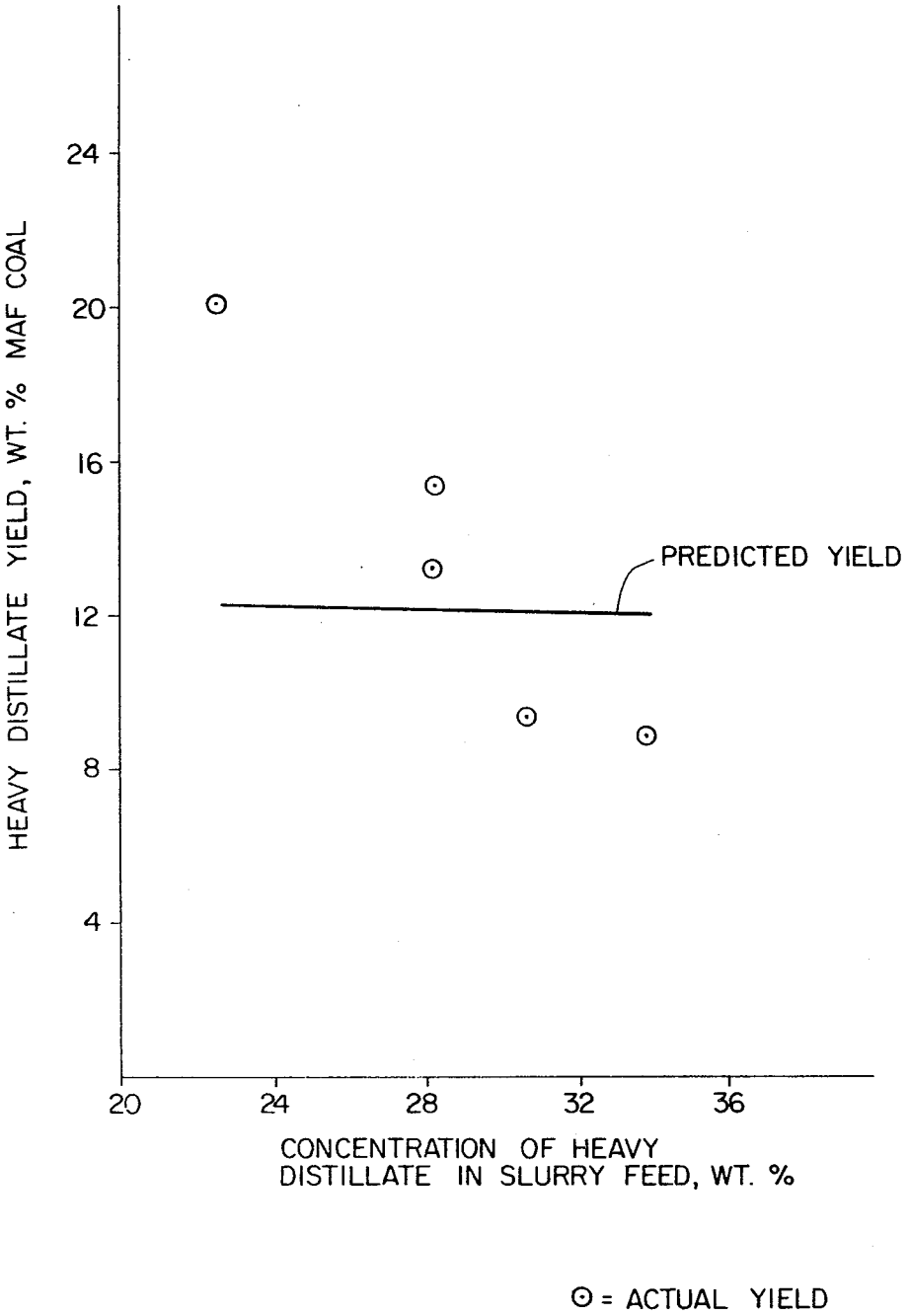
FIG. 3 graphically illustrates the unpredictability of the effect of increasing the concentration of recycle heavy distillate upon the heavy distillate yield in accordance with the process of the present invention.

FIGS. 2 and 3 show the effect of recycle distillate composition upon product distillate composition. Since the concentration of total distillate (light distillate plus heavy distillate) is approximately the same for all experiments, the concentration of light or heavy distillate is also a measure of the ratio of light distillate to heavy distillate. The actual data points shown in FIGS. 2 and 3 were taken from Tables 1 and 2. The solid line shown in FIG. 2 was obtained by mathematical correlation based upon a large number of experiments carried out under various conditions and indicate little or no effect of recycle distillate composition upon predicted yields of light and heavy distillates. The actual data points show, unpredictably, that the yield of light distillate increases as the concentration of heavy distillate (shown as a decrease in light distillate concentration) in the slurry feed is increased. Similarly, the solid line in FIG. 3 obtained by mathematical correlation predicts that the concentrations of light and heavy fuel oil, respectively, in the recycle distillate have little or no effect upon the relative yields of light and heavy distillate. However, the actual data points show that increasing the concentration of light distillate in the feed slurry (shown as a decrease in heavy distillate concentration) actually will cause an increase in the heavy distillate concentration in the fuel oil distillate product.

Based upon data, including that of Tables I and II, the following algebraic expressions were developed to show the effect of the light to heavy distillate ratio in the feed slurry upon the yields of light and heavy distillates:

$$LD_2 = LD_1 - 37(R_2 - R_1) \quad \text{(I)}$$

$$HD_2 = HD_1 + 28(R_2 - R_1) \quad \text{(II)}$$

wherein $LD_2$ = Desired yield* of light distillate $LD_1$ = Measured yield* of light distillate $HD_2$ = Desired yield* of heavy distillate $HD_1$ = Measured yield* of heavy distillate $R_2$ = Desired weight ratio of light/heavy distillate in feed slurry $R_1$ = Measured weight ratio of light/heavy distillate in feed slurry

*Yield is expressed as weight percent MAF coal.

When using the foregoing algebraic expressions, (I) and (II), it is assumed that the other process conditions remain constant.

It was found that the basic relationships between the ratio of light/heavy distillate in the feed slurry and light/heavy distillate yields can be expressed by equations (I) and (II) over a wide range of liquefaction reactor conditions.

Such strong interdependence of fuel oil product distribution upon the composition of the light and heavy fuel oil in the slurry liquid permits the continuous control of light and heavy fuel oil yield distribution.

Although the invention has been described in considerable detail with particular reference to certain preferred embodiments thereof, variations and modifications can be effected within the spirit and scope of the invention as described hereinbefore, and as defined in the appended claims.

What is claimed is:

1. A continuous process for controlling the relative ratio of heavy distillate to light distillate produced in a coal liquefaction process, which comprises passing a mineral-containing feed coal, hydrogen, recycle normally solid dissolved coal, recycle mineral residue and a liquid solvent to a coal liquefaction zone, said liquid solvent comprising a heavy distillate and a light distillate in a predetermined ratio of heavy distillate to light distillate to dissolve hydrocarbonaceous material of said feed coal and to hydrocrack said hydrocarbonaceous material to produce a product fuel oil containing heavy distillate and light distillate, wherein the ratio of heavy distillate to light distillate in the product fuel oil varies inversely with the ratio of heavy distillate to light distillate in the liquid solvent, and continuously controlling the weight ratio of heavy distillate to light distillate in the fuel oil product by varying the weight ratio of heavy distillate to light distillate fed to the liquefaction zone inversely to the desired weight ratio of heavy distillate to light distillate in the fuel oil product, said heavy distillate and said light distillate in said liquid solvent comprising recycle distillate fractions, said heavy distillate boiling in the range of between about 550° F. (288° C.) to about 900° F. (482° C.) and said light distillate boiling in the range of between about 380° F. (193° C.) to about 550° F. (288° C.), said liquid solvent comprising heavy distillate and light distillate in a ratio of heavy distillate to light distillate of greater than 3:1 on a weight basis.

2. The process of claim 1 wherein said heavy distillate boils in the range of between 600° F. (316° C.) to 800° F. (427° C.) and said light distillate boils in the range of between 400° F. (204° C.) to 500° F. (260° C.).

3. The process of claim 1 wherein said liquid solvent comprises heavy distillate and light distillate in a ratio of heavy distillate to light distillate of between about 4:1 to about 20:1 on a weight basis.

4. The process of claim 3 wherein said liquid solvent comprises heavy distillate and light distillate in a ratio of heavy distillate to light distillate of between about 5:1 to about 20:1 on a weight basis.

5. The process of claim 1 wherein said product fuel oil contains heavy distillate and light distillate in a ratio of below about 1.5:1 on a weight basis.

6. The process of claim 5 wherein said product fuel oil contains heavy distillate and light distillate in a ratio of between about 0.2:1 to about 1:1.

7. The process of claim 1 wherein said product fuel oil contains light distillate and heavy distillate in a ratio of light distillate to heavy distillate of less than about 0.6:1 on a weight basis.

8. The process of claim 7 wherein said product fuel oil contains light distillate and heavy distillate in a ratio of light to heavy distillate of between about 0.01:1 to about 0.6:1 on a weight basis.

9. The process of claim 8 wherein said product fuel oil contains light distillate and heavy distillate in a ratio of light distillate to heavy distillate of between about 0.05:1 to about 0.3:1 on a weight basis.

10. The process of claim 1 wherein said light distillate in said liquid solvent and said heavy distillate in said liquid solvent comprise recycle distillate fractions and the amount of each said fraction that is recycled is controlled by automatically and continuously monitoring each said fraction to provide predetermined concentrations of said fractions in said liquid solvent.

11. The process of claim 1 wherein said light distillate in said liquid solvent is obtained by recycling a light distillate fraction from an atmospheric distillation zone and said heavy distillate in said liquid solvent is obtained by recycling a heavy distillate fraction from a vacuum distillation zone, and the amount of each said fraction that is recycled is controlled by automatically and continuously monitoring each of said fractions to provide predetermined concentrations of said fractions in said liquid solvent.

12. The process of claim 1 wherein said liquid solvent composition is controlled by recycling a fraction comprising light distillate and heavy distillate for admixture with said feed coal, said recycled fractions being obtained from the same distillation zone.

13. The process of claim 1 wherein said coal liquefaction process is conducted in the absence of an external catalyst.

14. The process of claim 1 wherein said heavy distillate boils in the range of between 600° F. (316° C.) to 800° F. (427° C.) and said light distillate boils in the range of between 400° F. (204° C.) to 550° F. (288° C.).

15. A coal liquefaction process for maximizing the concentration of light distillate produced, which comprises passing a mineral-containing feed coal, hydrogen, recycle normally solid dissolved coal, recycle mineral residue and a liquid solvent to a coal liquefaction zone. said liquid solvent comprising a heavy distillate boiling in the range of between about 550° F. (288° C.) to about 900° F. (482° C.) and a light distillate boiling in the range of between about 350° F. (177° C.) to about 550° F. (288° C.) in a predetermined ratio of heavy distillate to light distillate of greater than 7:1 on a weight basis to dissolve hydrocarbonaceous material of said feed coal and to hydrocrack said hydrocarbonaceous material to produce a product fuel oil containing heavy distillate and a high proportion of light distillate.

16. The process of claim 15 wherein said product fuel oil contains a ratio of heavy distillate to light distillate below about 1.5:1 on a weight basis.

17. The process of claim 15 wherein said liquid solvent contains heavy distillate and light distillate in a ratio of heavy distillate to light distillate of between about 7:1 to about 20:1 on a weight basis.

18. The process of claim 15 wherein said product fuel oil contains heavy distillate and light distillate in a ratio of about 0.2:1 to about 1:1.

19. The process of claim 15 wherein said liquid solvent contains heavy distillate and light distillate in a ratio of heavy distillate to light distillate of between about 7:1 to about 30:1 on a weight basis.

20. A continuous process for controlling the relative ratio of heavy distillate to light distillate produced in a coal liquefaction process, which comprises passing a mineral-containing feed coal, hydrogen, recycle normally solid dissolved coal, recycle mineral residue and a liquid solvent to a coal liquefaction zone, said liquid solvent comprising a heavy distillate and a light distillate in a predetermined ratio of heavy distillate to light distillate to dissolve hydrocarbonaceous material of said feed coal and to hydrocrack said hydrocarbonaceous material to produce a product fuel oil containing heavy distillate and light distillate, wherein the ratio of heavy distillate to light distillate in the product fuel oil varies inversely with the ratio of heavy distillate to light distillate in the liquid solvent, and continuously controlling the weight ratio of heavy distillate to light distillate in the fuel oil product by varying the weight ratio of heavy distillate to light distillate fed to the liquefaction zone inversely to the desired weight ratio of heavy distillate to light distillate in the fuel oil product, said heavy distillate and said light distillate in said liquid solvent comprising recycle distillate fractions, said heavy distillate boiling in the range of between about 550° F. (288° C.) to about 900° F. (482° C.) and said light distillate boiling in the range of between about 380° F. (193° C.) to about 550° F. (288° C.), said liquid solvent comprising heavy distillate and light distillate in a ratio of light distillate to heavy distillate of greater than 3:1 on a weight basis.

21. The process of claim 20 wherein said liquid solvent comprises light distillate and heavy distillate in a ratio of light distillate to heavy distillate of between about 0.4:1 to about 4:1 on a weight basis.

22. The process of claim 21 wherein said liquid solvent comprises light distillate and heavy distillate in a ratio of light distillate to heavy distillate of between about 0.6:1 to about 3:1 on a weight basis.

23. A continuous process for controlling the relative ratio of heavy distillate to light distillate produced in a coal liquefaction process, which comprises passing a mineral-containing feed coal, hydrogen, recycle normally solid dissolved coal, recycle mineral residue and a liquid solvent to a coal liquefaction zone, said liquid solvent comprising a heavy distillate and a light distillate in a predetermined ratio of heavy distillate to light distillate to dissolve hydrocarbonaceous material of said feed coal and to hydrocrack said hydrocarbonaceous material to produce a product fuel oil containing heavy distillate and light distillate, wherein the ratio of heavy distillate to light distillate in the product fuel oil varies inversely with the ratio of heavy distillate to light distillate in the liquid solvent, and continuously controlling the weight ratio of heavy distillate to light distillate in the fuel oil product by varying the weight ratio of heavy distillate to light distillate fed to the liquefaction zone inversely to the desired weight ratio of heavy distillate to light distillate in the fuel oil product, said heavy distillate and said light distillate in said liquid solvent comprising recycle distillate fractions, said heavy distillate boiling in the range of between about 500° F. (260° C.) to about 900° F. (482° C.) and said light distillate boiling in the range of between about 350° F. (177° C.) to about 600° F. (316° C.), the desired light distillate yield, $LD_2$, being continuously controlled in substantial accordance with the formula:

$$LD_2 = LD_1 - 37\,(R_2 - R_1)$$

wherein $LD_2$ = Desired light distillate yield $LD_1$ = Measured light distillate yield $R_2$ = Desired weight ratio of light/heavy distillate in feed slurry $R_1$ = Measured weight ratio of light/heavy distillate in feed slurry.

24. A continuous process for controlling the relative ratio of heavy distillate to light distillate produced in a coal liquefaction process, which comprises passing a mineral-containing feed coal, hydrogen, recycle normally solid dissolved coal, recycle mineral residue and a liquid solvent to a coal liquefaction zone, said liquid solvent comprising a heavy distillate and a light distillate in a predetermined ratio of heavy distillate to light distillate to dissolve hydrocarbonaceous material of said feed coal and to hydrocrack said hydrocarbonaceous material to produce a product fuel oil containing heavy distillate and light distillate, wherein the ratio of heavy distillate to light distillate in the product fuel oil varies inversely with the ratio of heavy distillate to light distillate in the liquid solvent, and continuously controlling the weight ratio of heavy distillate to light distillate in the fuel oil product by varying the weight ratio of heavy distillate to light distillate fed to the liquefaction zone inversely to the desired weight ratio of heavy distillate to light distillate in the fuel oil product, said heavy distillate and said light distillate in said liquid solvent comprising recycle distillate fractions, said heavy distillate boiling in the range of between about 500° F. (260° C.) to about 900° F. (482° C.) and said light distillate boiling in the range of between about 350° F. (177° C.) to about 600° F. (316° C.), the desired heavy distillate yield, $HD_2$, being continuously controlled in substantial accordance with the formula:

$$HD_2 = HD_1 + 28\,(R_2 - R_1)$$

wherein $HD_2$ = Desired heavy distillate yield $HD_1$ = Measured heavy distillate yield $R_2$ = Desired weight ratio of light/heavy distillate in feed slurry $R_1$ = Measured weight ratio of light/heavy distillate in feed slurry.

25. A coal liquefaction process for maximizing the concentration of light distillate produced, which comprises passing a mineral-containing feed coal, hydrogen, recycle normally solid dissolved coal, recycle mineral residue and a liquid solvent to a coal liquefaction zone, said liquid solvent comprising a heavy distillate boiling in the range of between about 550° F. (288° C.) to about 900° F. (482° C.) and a light distillate boiling in the range of between about 350° F. (177° C.) to about 550° F. (288° C.) in a predetermined ratio of heavy distillate to light distillate of greater than 5:1 on a weight basis to dissolve hydrocarbonaceous material of said feed coal and to hydrocrack said hydrocarbonaceous material to produce a product fuel oil containing heavy distillate and a high proportion of light distillate, said product fuel oil containing a ratio of heavy distillate to light distillate below about 1.5:1 on a weight basis.

26. The process of claim 25 wherein said product fuel oil contains heavy distillate and light distillate in a ratio of about 0.2:1 to about 1:1.

27. The process of claim 25 wherein said heavy distillate boils in the range of between about 600° F. (316° C.) to 800° F. (427° C.) and said light distillate boils in the range of between about 400° F. (204° C.) to about 500° F. (260° C.).

* * * * *

UNITED STATES PATENT OFFICE

CERTIFICATE OF CORRECTION

Patent No. 4,364,817 Dated December 21, 1982

Inventor(s) R. P. Anderson, D. K. Schmalzer and C. H. Wright

It is certified that error appears in the above-identified patent and that said Letters Patent are hereby corrected as shown below:

Col. 4, line 22, "150" should be --105--.

Claim 20, Col. 11, line 4, "3:1" should be --0.4:1--.

Signed and Sealed this

Nineteenth Day of April 1983

[SEAL]

Attest:

GERALD J. MOSSINGHOFF

Attesting Officer

Commissioner of Patents and Trademarks